US008675898B2

(12) United States Patent
Akino

(10) Patent No.: US 8,675,898 B2
(45) Date of Patent: Mar. 18, 2014

(54) RIBBON MICROPHONE WITH AUTOMATIC PROTECTION SWITCH

(75) Inventor: Hiroshi Akino, Machida (JP)

(73) Assignee: Kabushiki Kaisha Audio-Technica, Machida-shi (JP)

( * ) Notice: Subject to any disclaimer, the term of this patent is extended or adjusted under 35 U.S.C. 154(b) by 8 days.

(21) Appl. No.: 13/346,313

(22) Filed: Jan. 9, 2012

(65) Prior Publication Data

US 2012/0189145 A1 Jul. 26, 2012

(30) Foreign Application Priority Data

Jan. 20, 2011 (JP) ..... 2011-009574

(51) Int. Cl.
*H04R 25/00* (2006.01)

(52) U.S. Cl.
USPC ..... 381/176

(58) Field of Classification Search
USPC ..... 381/176
See application file for complete search history.

(56) References Cited

U.S. PATENT DOCUMENTS

2011/0286612 A1* 11/2011 Cooper et al. ..... 381/123

OTHER PUBLICATIONS

Machine Translation of Japanese Publication No. 2009-218685.*
Machine Translation of Japanese Publication No. 2009-218685, which was published Sep. 2009.*

* cited by examiner

*Primary Examiner* — Brian Ensey
*Assistant Examiner* — Katherine Faley
(74) *Attorney, Agent, or Firm* — Manabu Kanesaka

(57) ABSTRACT

To provide electromagnetic damping without a special output connector for protecting a diaphragm of metallic ribbon foil of a ribbon microphone against shocks. A ribbon microphone operable with a phantom power supply comprises: an acoustic-electric converter 1 including a pair of permanent magnets and a diaphragm of metallic ribbon foil; and a step-up transformer 110 coupled with the diaphragm on a primary winding 111 side and having, on a secondary winding 112 side, an output connector 120 removably connected to a phantom power supply, the step-up transformer 110 increasing a voltage generated by the diaphragm to a predetermined voltage, the voltage then being output to the phantom power supply side through the output connector 120, wherein a switch 141 is connected across the secondary winding 112, the switch 141 being normally closed and being opened by a power supplied from the phantom power supply.

5 Claims, 2 Drawing Sheets

RIBBON MICROPHONE WITH AUTOMATIC PROTECTION SWITCH

CROSS-REFERENCE TO RELATED APPLICATION

The present application is based on, and claims priority from, Japanese Application Serial Number JP2011-009574, filed Jan. 20, 2011, the disclosure of which is hereby incorporated by reference herein in its entirety.

TECHNICAL FIELD

The present invention relates to a ribbon microphone having a metallic ribbon foil used as a diaphragm, and in particular to a technique for protecting the diaphragm against shocks or the like.

BACKGROUND ART

As shown in FIG. 2, such a ribbon microphone is provided with an acoustic-electric converter (i.e. microphone unit) 1. The converter 1 has a metallic foil such as an aluminum foil in the form of a strip of several micrometers thick as a diaphragm 10. The foil is placed in a parallel magnetic field formed by a pair of permanent magnets 30 facing each other with a predetermined space therebetween. Attachment electrodes 20, which include a pair of support electrode plates 20*a* and 20*b*, are attached to opposite ends 10*a* and 10*b* of the diaphragm 10.

Such a ribbon microphone is bi-directional and mass controlled. This significantly lowers the resonance frequency and allows sounds to be collected in a lower tone range.

A problem with a ribbon microphone is that, on impact against the microphone, an inertial force of the diaphragm (sometimes referred to as "ribbon") 10 stretches the ribbon foil, leaving it in an elongated state by plastic deformation. When a ribbon plastic-deformed in this way contacts a magnetic pole or a nearby component, the performance may significantly be degraded.

For this reason, it is a common practice to provide protections against shocks during transportation such as cushioning materials attached to the inside and/or outside of a box containing a microphone so as to avoid a direct impact on the microphone.

Besides shocks during transportation, however, other shocks on impact against a microphone include a drop impact experienced, for example, when the microphone is accidentally dropped while being handled on a microphone stand for attachment. It is therefore necessary to protect a ribbon against shocks also when the microphone is not in use (i.e. when the microphone is deactivated) except for transportation.

Thus, the applicant has proposed in Japanese Patent Application Publication No. 2009-218685 to suppress vibrations of a ribbon by electromagnetic damping when the microphone is not in use.

The arrangement will now be described briefly. There is provided a mechanical switch that turns on (i.e. closed), for example, when a plug provided on an end of a cable (i.e. cable end plug) on the phantom power supply side is not plugged into an output connector of ribbon microphone and turns off (i.e. open) once the cable end plug is plugged. The switch is turned on and off across the ribbon.

In this way, when the cable end plug on the power supply side is not plugged into the output connector and the microphone is not in use, the switch turns on to create an electrically short circuit across the ribbon, resulting in a closed circuit including the ribbon.

In this state, if the ribbon is moved within the parallel magnetic field (i.e. magnetic gap) on impact against the microphone, a back electromotive force is generated in the ribbon. The back electromotive force causes a current to flow through the closed circuit to generate an electromagnetic braking force. Since the braking force acts in the direction opposite to the direction of vibration of the ribbon, the vibrations of the ribbon can be suppressed.

As described above, according to the invention set forth in Japanese Patent Application Publication No. 2009-218685, when the cable end plug on the power supply side is not plugged into the output connector during transportation or while the microphone is being handled for installation, the movement of the ribbon is restricted by electromagnetic damping even upon impact against the microphone. Thus, the elongation, along with plastic deformation, of the ribbon can be prevented.

In the invention set forth in Japanese Patent Application Publication No. 2009-218685, however, a mechanical switch, which is turned on and off by the cable end plug, is provided on the output connector. Therefore, a custom-designed, special output connector is required.

An object of the invention, therefore, is to provide electromagnetic damping without a special output connector, in order to protect a diaphragm of metallic ribbon foil of a ribbon microphone against shocks.

SUMMARY OF THE INVENTION

To solve the above problem, the present invention is characterized by a ribbon microphone operable with a phantom power supply, comprising: an acoustic-electric converter including a pair of permanent magnets that form a parallel magnetic field and a diaphragm of metallic ribbon foil that is placed in the parallel magnetic field and vibrates in response to incoming sound waves; and a step-up transformer coupled with the diaphragm on a primary winding side and having, on a secondary winding side, an output connector to which a phantom power supply is removably connected, the step-up transformer increasing a voltage generated by the diaphragm to a predetermined voltage, the voltage then being output to the phantom power supply side through the output connector, wherein a switch is connected across the secondary winding, the switch being normally closed and being opened by a power supplied from the phantom power supply.

In the invention, the switch preferably comprises a normally closed photorelay including a light emitting diode that emits light by a power supplied from the phantom power supply.

According to the invention, in a ribbon microphone operable with a phantom power supply, a switch (preferably a normally closed photorelay including a light emitting diode that emits light by a power supplied from a phantom power supply) is connected across the secondary winding of a step-up transformer, and the switch is normally closed and is opened by a power supplied from the phantom power supply. In this way, when the phantom power supply is not connected and the microphone is not in use, the switch is closed (i.e. turned on) to leave the secondary winding side in a short-circuited state, which extremely reduces impedance on the primary winding side according to the impedance ratio of the step-up transformer ($1:N^2$, where N is the number of turns on the secondary side) to create a closed circuit including the diaphragm. This provides electromagnetic damping on the diaphragm. On the other hand, when the phantom power supply is connected for supplying a power (and the microphone is in use), the switch turns off (i.e. opened), which releases the electromagnetic damping on the diaphragm. The invention, therefore, eliminates the need for a special connector incorporating a mechanical switch as set forth in Japanese Patent Application Publication No. 2009-218685, thereby improving versatility.

DETAILED DESCRIPTION

An embodiment of the invention will now be described with reference to FIG. 1, although the present invention is not limited to the embodiment.

Figure 1:
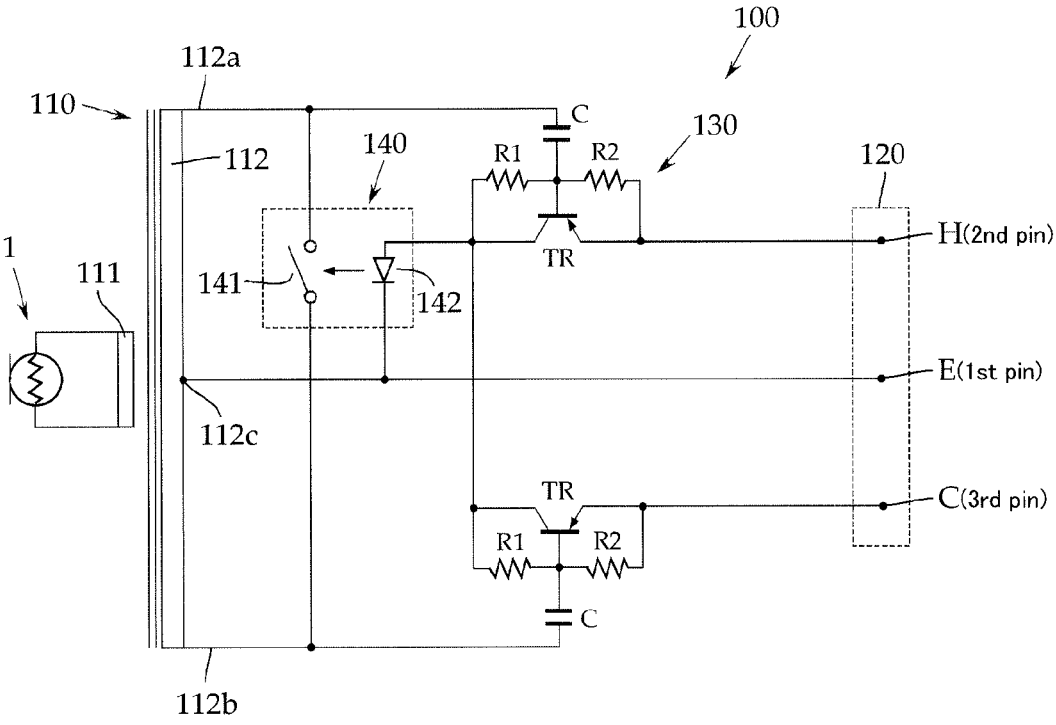
FIG. 1 is a diagram showing a circuit configuration according to an embodiment of a ribbon microphone of the invention.
Figure 2:
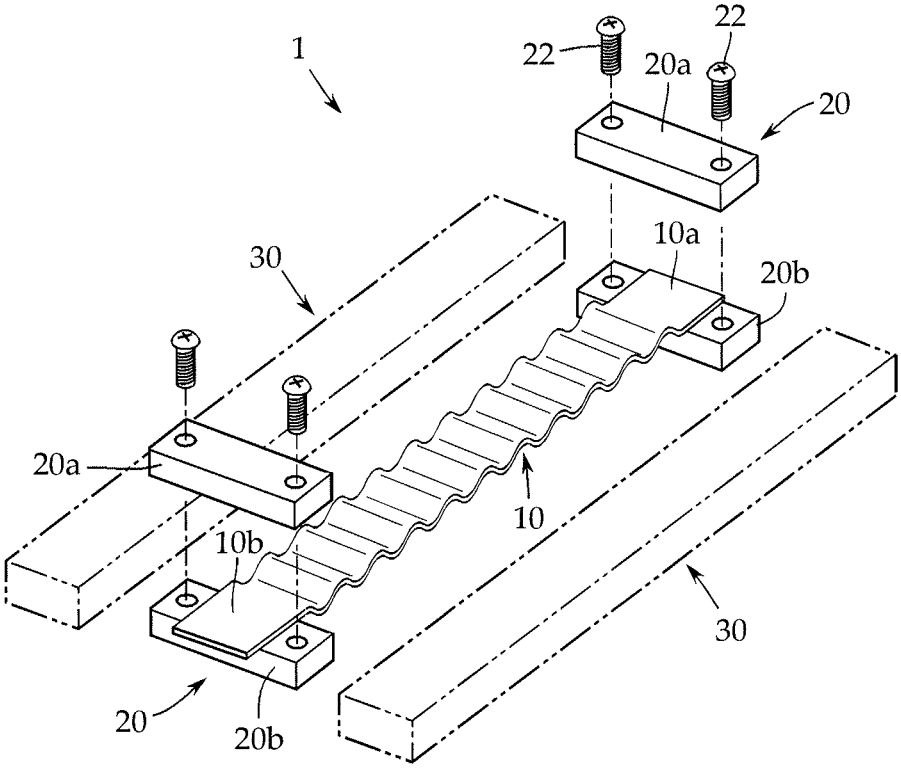
FIG. 2 RELATED ART
FIG. 2 is a perspective view showing a basic configuration of the ribbon microphone.

As shown in FIG. 1, a ribbon microphone 100 according to the embodiment is provided with an acoustic-electric converter (i.e. microphone unit) 1 having a ribbon foil used as a diaphragm. With reference to FIG. 2 again, the acoustic-electric converter 1 may have a metallic foil such as an aluminum foil in the form of a strip of several micrometers thick as a diaphragm 10. The foil is placed in a parallel magnetic field formed by a pair of permanent magnets 30 facing each other with a predetermined space therebetween.

Since the ribbon microphone 100 is operable with a phantom power supply (not shown), the ribbon microphone 100 is provided with a step-up transformer 110 and an output connector 120 that is to be connected to the phantom power supply.

Attachment electrodes 20 attached to opposite ends of the diaphragm 10 (see FIG. 2) are connected across the primary winding 111 of the step-up transformer 110. An output connector 120 is connected to the secondary winding 112 of the step-up transformer 110 via emitter follower circuits 130 for impedance conversion.

A transformer with a high voltage step-up ratio is used as the step-up transformer 110. In this embodiment, the voltage step-up ratio (i.e. turns ratio) is 1:180. Since the impedance ratio of the primary winding 111 to the secondary winding 112 is represented by $1:N^2$, where N is the number of turns on the secondary side, the impedance ratio of the primary winding 111 to the secondary winding 112 of the embodiment is 1:32400.

The output connector 120 is a 3-pin connector specified in EIAJ RC-5236 "Latch Lock Type Round Connector for Audio Equipment" and has a first pin E for ground, a second pin H for hot, and a third pin C for cold. This corresponds to a cannon XLR-3 connector.

A round plug (not shown) provided on an end of a microphone cable (i.e. cable end plug) for the phantom power supply is plugged into the output connector 120. The microphone cable is a balanced 2-conductor shielded cable and acts as both a power feed line and a signal line.

The first pin E in the output connector 120 is connected to a center tap 112*c* of the secondary winding 112. The second pin H and the third pin C are connected to one end 112*a* and the other end 112*b* of the secondary winding 112 via emitter follower circuits 130, respectively.

In this embodiment, each of the emitter follower circuits 130 includes a PNP transistor TR, the collector of which is connected to that of the other PNP transistor TR, a DC-blocking capacitor C, and resistors R1 and R2 for regulating a bias current flowing through the base of transistor.

The ribbon microphone 100 is operated by a power supplied from the phantom power supply connected to the output connector 120. In the microphone 100, the acoustic-electric converter 1 including the diaphragm 10 in the shape of a ribbon picks up a sound signal, the step-up transformer 110 increases the level of the sound signal, the emitter follower circuits 130 each reduce output impedance, and the sound signal is output to the phantom power supply side through the output connector 120.

In this embodiment, similarly to Japanese Patent Application Publication No. 2009-218685, electromagnetic damping is provided on the diaphragm (i.e. ribbon) 10 in order to prevent plastic deformation of the diaphragm 10, which otherwise leaves the diaphragm in an elongated state, on great impact against the microphone, such as a drop impact, occurring when the microphone is not in use. Description will be made below to the approach to the solution.

As described above, since the impedance ratio of the primary winding 111 to the secondary winding 112 of the step-up transformer 110 is $1:N^2$, a normally closed switch 141 is connected between ends 112*a* and 112*b* of the secondary winding 112 of the step-up transformer 110 for creating a short circuit between the ends, and the switch 141 needs to be opened (i.e. turned off) when the microphone is in use.

To that end, in this embodiment, a photorelay switch is used as the switch 141, and a light emitting diode 142 that emits light by a power supplied from a phantom power supply is disposed near the switch 141. As illustrated in FIG. 1, the light emitting diode 142 may be connected between the collector of the transistor TR in the emitter follower circuit 130 on the side of the second pin H and the first pin E.

In view of the simplification of components and workability for assembly, it is preferred to use a photorelay 140, which combines the switch 141 and the light emitting diode 142 into a package. Packaged components of this type include, among others, normally closed photorelays TLP4227G and TLP4597G incorporating MOSFETs available from Toshiba Corporation.

As an example, consider that the voltage step-up ratio of the step-up transformer 110 is 1:180, the impedance ratio therefore being 1:32400, and that the resistance of the diaphragm 10 is 0.2 Ω and the contact resistance of the switch 141 is 15Ω.

When the switch 141 is open, the impedance ratio is 0.2 :6480Ω. On the other hand, when the switch 141 is closed, the resistance on the secondary side falls to the contact resistance or 15Ω. The primary side is then 15/32400≅0.46 Ω. This substantially creates a short circuit across the diaphragm 10 to form a closed circuit including the diaphragm 10.

In this state, if the diaphragm 10 is moved within the parallel magnetic field (i.e. magnetic gap) on impact against the microphone, a back electromotive force is generated in the diaphragm 10. The back electromotive force causes a current to flow through the closed circuit to generate an electromagnetic braking force. Since the braking force acts in the direction opposite to the direction of vibration of the diaphragm 10, the vibrations of the diaphragm 10 can be suppressed.

In this way, the diaphragm 10 can be effectively protected against, for example, shocks during transportation, shocks caused by a drop impact during installation onto a microphone stand, and other shocks while a phantom power supply is not connected.

Meanwhile, when the microphone is in use with a cable end plug plugged into the output connector 120 and a power supplied from a phantom power supply, the light emitting diode 142 emits light to open the switch 141, which releases the electromagnetic damping on the diaphragm 10.

The invention claimed is:

1. A ribbon microphone operable with a phantom power supply, comprising:

an acoustic-electric converter including a pair of permanent magnets that forms a parallel magnetic field, and a diaphragm of metallic ribbon foil that is placed in the parallel magnetic field and vibrates in response to incoming sound waves;

a step-up transformer coupled with the diaphragm on a primary winding side and having, on a secondary winding side, an output connector to which a phantom power supply is removably connected, the step-up transformer increasing a voltage generated by the diaphragm to a predetermined voltage, the voltage then being output to a phantom power supply side through the output connector, a switch connected across secondary windings, the switch being closed when a power is not supplied from the phantom power supply so that two ends of the diaphragm on the primary winding side are substantially short-circuited by an impedance ratio of the step-up transformer to form a closed circuit including the diaphragm to thereby generate a brake electromotive force to the diaphragm upon movement of the diaphragm, and two emitter follower circuits connected to the secondary windings, the emitter follower circuits being adapted to be connected to the output connector.

2. The ribbon microphone according to claim 1, wherein the switch comprises a switch member connected across the secondary windings, and a photorelay including a light emitting diode situated adjacent to the switch member and emitting light by a power supplied from the phantom power supply.

3. A ribbon microphone operable with a phantom power supply, comprising:

an acoustic-electric converter including a pair of permanent magnets that forms a parallel magnetic field, and a diaphragm of metallic ribbon foil that is placed in the parallel magnetic field and vibrates in response to incoming sound waves;

a step-up transformer coupled with the diaphragm on a primary winding side and having, on a secondary winding side, an output connector to which a phantom power supply is removably connected, the step-up transformer increasing a voltage generated by the diaphragm to a predetermined voltage, the voltage then being output to a phantom power supply side through the output connector, a photorelay switch having a switch member connected across secondary windings, and a light emitting diode placed adjacent to the switch member and emitting light by a power supplied from the phantom power supply, the switch member being closed when a power is not supplied from the phantom power supply to the light emitting diode so that two ends of the diaphragm are substantially short-circuited to form a closed circuit including the diaphragm, and being opened when the power is supplied to the light emitting diode, and two emitter follower circuits connected to the secondary windings, the emitter follower circuits being adapted to be connected to the output connector.

4. The ribbon microphone according to claim 3, wherein the diaphragm is arranged such that when the diaphragm in the closed circuit is moved, a back electromotive force is generated in the closed circuit to generate an electromagnetic braking force to act in a direction opposite to a direction of movement of the diaphragm thereby suppressing the movement of the diaphragm.

5. A ribbon microphone operable with a phantom power supply, comprising:

an acoustic-electric converter including a pair of permanent magnets that forms a parallel magnetic field, and a diaphragm of metallic ribbon foil that is placed in the parallel magnetic field and vibrates in response to incoming sound waves;

a step-up transformer coupled with the diaphragm on a primary winding side and having, on a secondary winding side, an output connector to which a phantom power supply is removably connected, the step-up transformer increasing a voltage generated by the diaphragm to a predetermined voltage, the voltage then being output to a phantom power supply side through the output connector, a photorelay switch having a switch member connected across secondary windings, and a light emitting diode placed adjacent to the switch member and emitting light by a power supplied from the phantom power supply, the switch member being closed when a power is not supplied from the phantom power supply to the light emitting diode so that two ends of the diaphragm are substantially short-circuited to form a closed circuit including the diaphragm, and being opened when the power is supplied to the light emitting diode, and an emitter follower circuit adapted to be connected to a second pin of the output connector and having a transistor, the light emitting diode being connected at one end to a collector of the transistor of the emitter follower circuit and being adapted to be connected at another end to a first pin of the output connector, wherein the diaphragm is arranged such that when the diaphragm in the closed circuit is moved, a back electromotive force is generated in the closed circuit to generate an electromagnetic braking force to act in a direction opposite to a direction of movement of the diaphragm thereby suppressing the movement of the diaphragm.

* * * * *